US008764965B2

(12) United States Patent
Joshi

(10) Patent No.: US 8,764,965 B2
(45) Date of Patent: Jul. 1, 2014

(54) ELECTROCHEMICAL CONVERSION OF ALKALI SULFATE INTO USEFUL CHEMICAL PRODUCTS

(75) Inventor: Ashok V. Joshi, Salt Lake City, UT (US)

(73) Assignee: Ceramatec, Inc., Salt Lake City, UT (US)

( * ) Notice: Subject to any disclaimer, the term of this patent is extended or adjusted under 35 U.S.C. 154(b) by 174 days.

(21) Appl. No.: 13/360,653

(22) Filed: Jan. 27, 2012

(65) Prior Publication Data

US 2012/0273365 A1 Nov. 1, 2012

Related U.S. Application Data

(60) Provisional application No. 61/436,979, filed on Jan. 27, 2011.

(51) Int. Cl.
*C25B 1/16* (2006.01)
*C01B 17/26* (2006.01)
*C01B 31/18* (2006.01)

(52) U.S. Cl.
USPC ..... 205/510; 423/418.2; 423/499.1; 423/566; 423/566.2; 423/571

(58) Field of Classification Search
USPC ..... 205/510; 423/418.2, 499.1, 566, 566.2, 423/571
See application file for complete search history.

(56) References Cited

U.S. PATENT DOCUMENTS 3,402,995 A * 9/1968 Bach ..... 423/499.1
4,544,459 A 10/1985 Struck et al.
5,391,267 A 2/1995 Zoppi
5,593,552 A 1/1997 Joshi et al.
2009/0134040 A1 5/2009 Gordon et al.

OTHER PUBLICATIONS

Cameron, J.H and Grace, T.M. "Kinetic Study of Sulfate Reduction with Carbon." Industrial & Engineering Chemistry Fundamentals. Nov. 1983. vol. 22, Issue 4. pp. 486-494.*

Kim, Kwang C., "International Search Report", PCT Application No. PCT/US2012/023044 (Corresponding to U.S. Appl. No. 13/360,653, (Sep. 27, 2012),1-3.

Kim, Kwang C., "Written Opinion of the International Searching Authority", PCT Application No. PCT/US2012/023044 (Corresponding to U.S. Appl. No. 13/360,653, (Sep. 27, 2012),1-4.

* cited by examiner

*Primary Examiner* — Keith Hendricks
*Assistant Examiner* — Steven A. Friday
(74) *Attorney, Agent, or Firm* — David Fonda

(57) ABSTRACT

Electrochemical processes to convert alkali sulfates into useful chemical products, such as syngas, alkali hydroxide, and sulfur are disclosed. An alkali sulfate is reacted with carbon to form carbon monoxide and alkali sulfide. In one embodiment, the alkali sulfide is dissolved in water and subjected to electrochemical reaction to form alkali hydroxide, hydrogen, and sulfur. In another embodiment, the alkali sulfide is reacted with iodine to form alkali iodide sulfur in a non-aqueous solvent, such as methyl alcohol. The alkali iodide is electrochemically reacted to form alkali hydroxide, hydrogen, and iodine. The iodine may be recycled to react with additional alkali sulfide. The hydrogen and carbon monoxide from both embodiments may be combined to form syngas. The alkali hydroxide from both embodiments may be recovered as a useful industrial chemical.

10 Claims, 4 Drawing Sheets

ELECTROCHEMICAL CONVERSION OF ALKALI SULFATE INTO USEFUL CHEMICAL PRODUCTS

CROSS-REFERENCE TO RELATED APPLICATIONS

Figure 1:
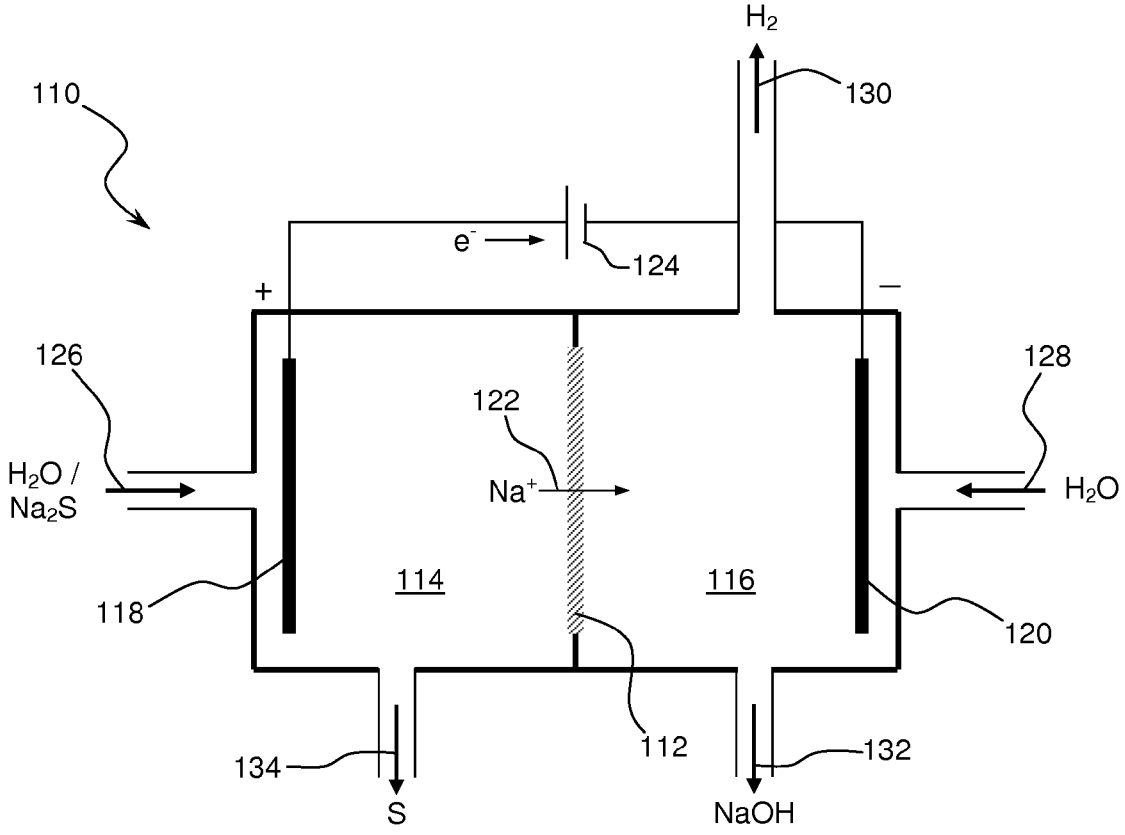

This application claims the benefit of, and priority to U.S. Provisional Application No. 61/436,979, filed Jan. 27, 2011. This non-provisional application is expressly incorporated herein by reference.

FIELD OF THE INVENTION

The present invention relates to the electrochemical treatment of alkali sulfate to form commercially valuable chemical products. More specifically, the present invention relates to electrochemically converting an alkali sulfate by reacting it with carbon and forming an aqueous or non aqueous metal sulfide that can be electrolyzed into useful chemical products, including alkali hydroxide, sulfur, and syngas.

BACKGROUND

Chemical products are used in a wide variety of useful applications. One problem with chemical products is that they are difficult and expensive to transport. Another problem is that they are expensive to manufacture. Many industrial applications create as a byproduct a waste stream that contains amounts of chemicals that must be contained or otherwise properly disposed of. It would be an advancement in the art to have methods and apparatuses that can create chemical products on site to reduce the need for transporting the chemicals. It would be a further advancement to be able to create useful chemical products from waste streams or other inexpensive or underutilized feed streams. Such methods and apparatuses are disclosed and claim herein.

SUMMARY OF THE INVENTION

In one embodiment, a process for electrochemically converting an alkali sulfate into useful chemical products includes reacting an alkali sulfate with carbon according to reaction (1):

$$M_2SO_4+4C \leftrightarrow 4CO+M_2S \quad (1)$$

The $M_2S$ may be dissolved in a liquid to form an aqueous or nonaqueous $M_2S$. In another embodiment, the $M_2S$ may be further reacted with iodine in a methyl alcohol solvent according to reaction (2):

$$M_2S+I_2 \leftrightarrow 2MI+S \quad (2)$$

In these reactions, M is an alkali metal such as, for example, a sodium metal, a lithium metal, a potassium metal, or other alkali metal.

An electrolytic cell comprising an alkali ion conducting membrane configured to selectively transport alkali ions may be provided. The membrane is positioned between an anolyte compartment configured with an anode and a catholyte compartment configured with a cathode. In one embodiment, aqueous or nonaqueous $M_2S$ of equation (1) may be introduced into the anolyte compartment. In another embodiment, MI in methyl alcohol from equation (2) may be introduced into the anolyte compartment. Water may then be introduced into the catholyte compartment.

In one embodiment, aqueous or nonaqueous $M_2S$ and water are electrolyzed in the electrolytic cell to form NaOH, $H_2$ and sulfur, according to reaction (3):

$$M_2S+2H_2O \leftrightarrow 2MOH+S+H_2 \quad (3)$$

In yet another embodiment, MI and water are electrolyzed in the electrolytic cell to form MOH, $H_2$ and iodine, according to reaction (4):

$$2MI+2H_2O \leftrightarrow 2MOH+I_2+H_2 \quad (4)$$

The CO from reaction (1) and $H_2$ from reaction (3) or (4) may be recovered and combined to form syngas.

BRIEF DESCRIPTION OF THE SEVERAL DRAWINGS

Embodiments of the present invention will be best understood by reference to the enclosed drawings. It will be readily understood that the components of the present invention, as generally described and illustrated in the figures herein, could be arranged and designed in a wide variety of different configurations. Thus, the following more detailed description of the embodiments of the methods and cells of the present invention, as represented in FIGS. 1 and 2, and is not intended to limit the scope of the invention, as claimed, but is merely representative of presently preferred embodiments of the invention.

Figure 2:
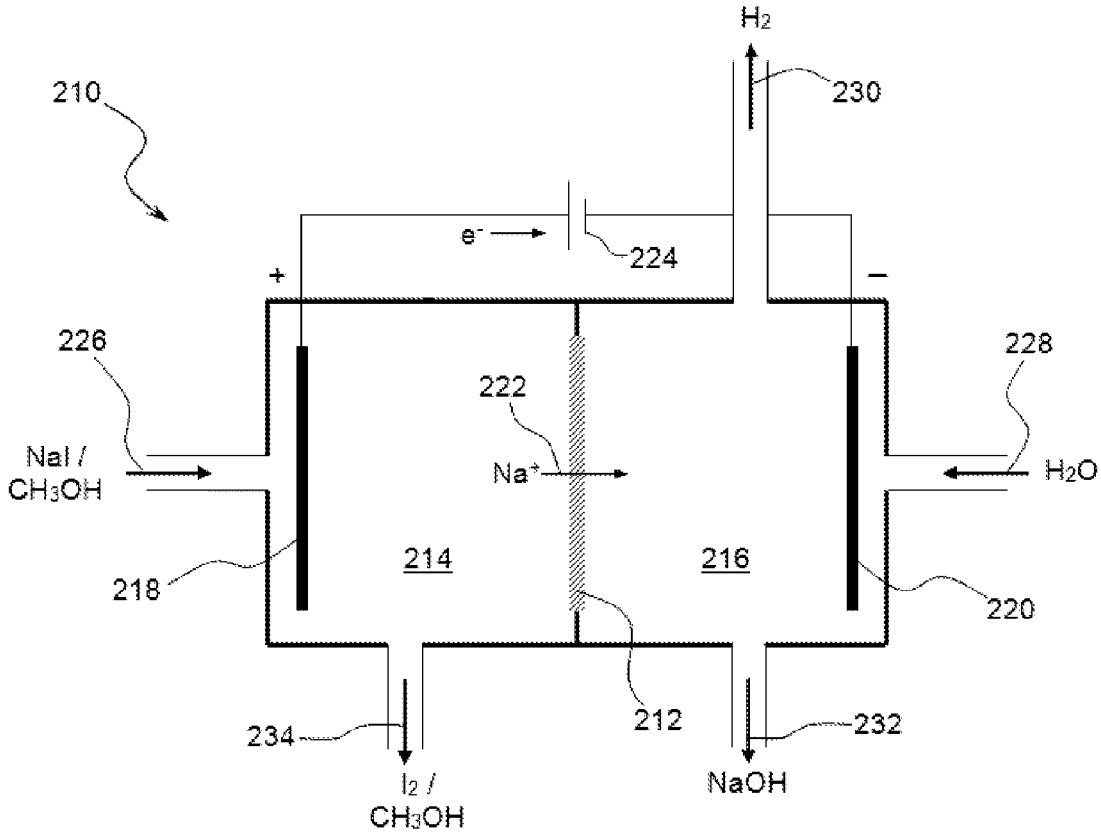
Figure 3:
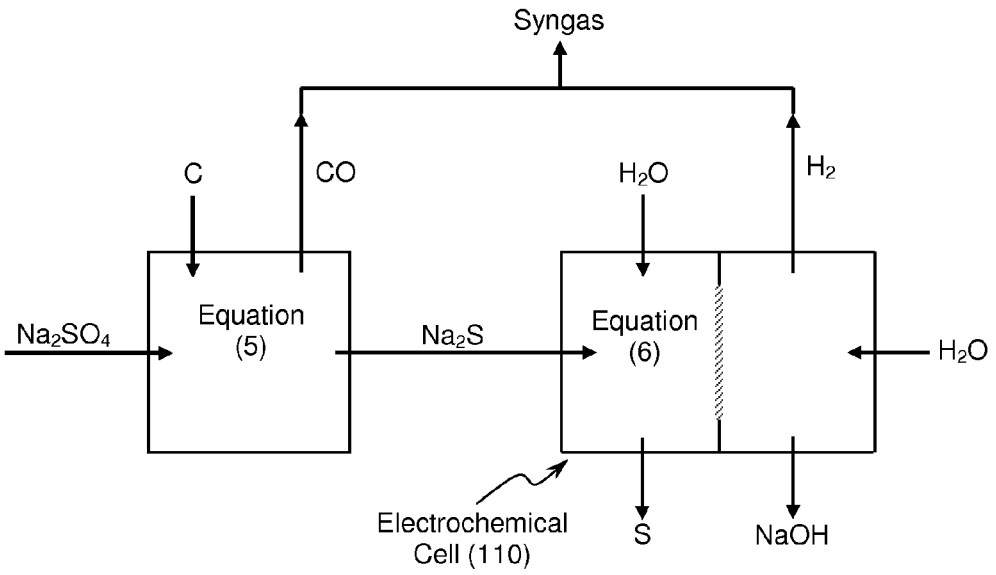
Figure 4:
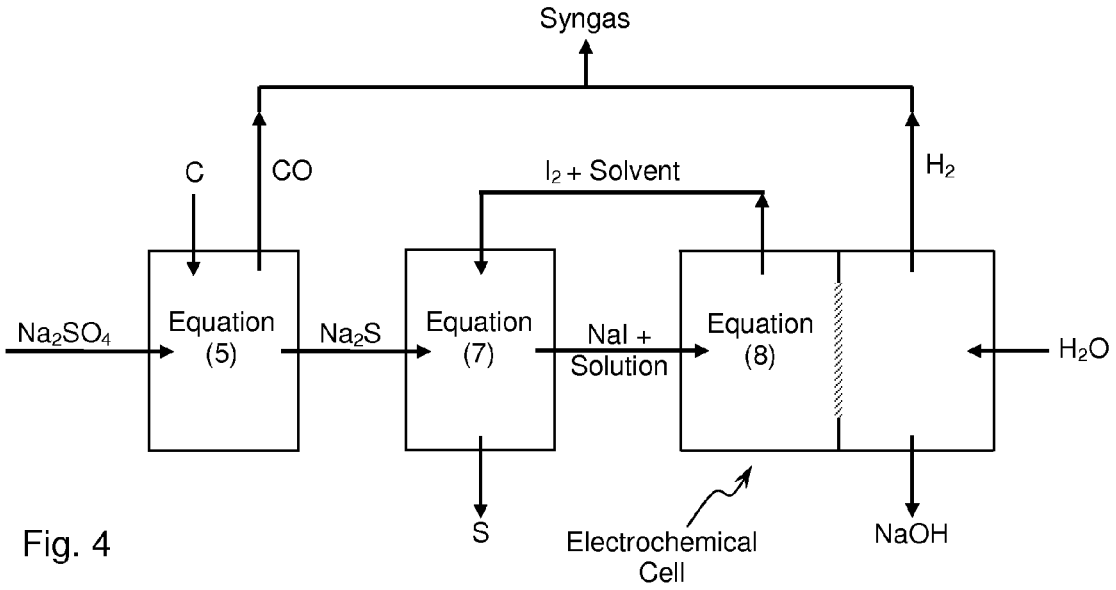
Figure 5:
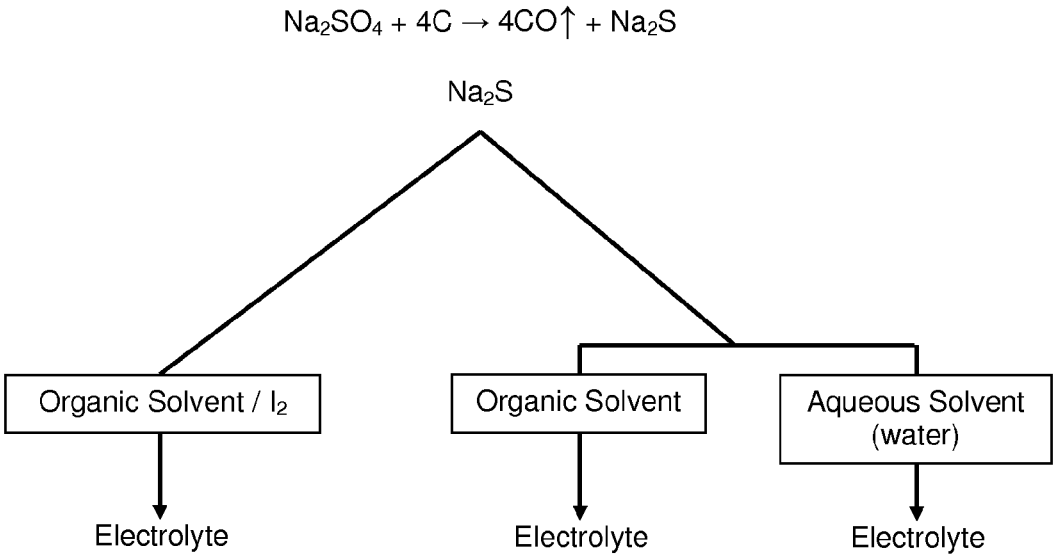

FIG. 1 discloses a schematic diagram of one embodiment of the present invention;

FIG. 2 discloses a schematic diagram of another embodiment of the present invention;

FIG. 3 discloses a schematic diagram of another embodiment of the present invention;

FIG. 4 discloses a schematic diagram of another embodiment of the present invention; and FIG. 5 discloses a flow diagram of one embodiment of the present invention.

DETAILED DESCRIPTION

It will be readily understood that the components of the embodiments as generally described herein and illustrated in the appended Figures could be arranged and designed in a wide variety of different configurations. Thus, the following more detailed description of various embodiments, as represented in the Figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

In the following description, specific details of various embodiments are provided. However, some embodiments may be practiced without at least some of these specific details. In other instances, certain methods, procedures, components, and circuits are not described in detail for the sake of brevity and clarity, but are nevertheless understood from the context of the description herein.

In general, alkali sulfates, such as sodium sulfate and potassium sulfate, are common in industrial waste streams. This invention relates to the electrochemical treatment of alkali sulfate to form commercially valuable chemical products. Such chemical products include, but are not limited to, alkali hydroxide, sulfur, and syngas (also known as synthetic gas or synthesis gas). While the following disclosure relates to a specific alkali sulfate, sodium sulfate ($Na_2SO_4$), it is understood that the disclosed invention relates to treatment of alkali sulfates in general, and where the disclosure references sodium, other alkali metals such as lithium and potassium may also be included.

Embodiment 1

The disclosure relates to processes for converting sodium sulfate into useful chemical products. One embodiment of the $Na_2SO_4$ conversion method includes the step of reacting $Na_2SO_4$ with carbon to make $Na_2S$ and CO, according to Equation (5):

$$Na_2SO_4+4C \leftrightarrow 4CO+Na_2S \quad (5)$$

The carbon may come from a variety of sources, including but not limited to coal, charcoal, tar, lignin, etc. This reaction proceeds by heating the sodium sulfate and carbon at a temperature sufficiently high to anaerobically "burn" the carbon in the sodium sulfate. The reaction can be achieved using excess carbon in sodium sulfate solid and igniting the mixture and collecting CO gas. A stoichiometric quantity of carbon is desirable, but excess carbon can be used to be react substantially all of the sodium sulfate. The carbon monoxide gas may be recovered and used in syngas production.

The process includes the steps of dissolving $Na_2S$ in water or organic solvents, and electrolyzing aqueous $Na_2S$ solution or organic solution of $Na_2S$ to form NaOH, $H_2$ and sulfur, according to Equation (6):

$$Na_2S+2H_2O \leftrightarrow 2NaOH+S+H_2 \quad (6)$$

The electrochemical process represented by Equation 6 preferably occurs in an electrolytic cell having a sodium ion conductive membrane. The membrane can comprise virtually any suitable sodium ion conductive membrane. Some non-limiting examples of such membranes include, but are not limited to, NaSICON (sodium super ionic conductor) membranes. Where other non-sodium alkali sulfates are treated within the scope of the present invention, it is to be understood that similar alkali ion conductive membranes such as a LiSICON membrane and a KSICON membrane may be used.

FIG. 1 schematically shows one possible electrolytic cell 110 that may be used in the electrochemical process of electrolyzing aqueous $Na_2S$ within the scope of the present invention. The electrolytic cell 110 uses a sodium ion conductive membrane 112 that divides the electrochemical cell 110 into two compartments: an anolyte compartment 114 and a catholyte compartment 116. An electrochemically active anode 118 is housed in the anolyte compartment 114 where oxidation reactions take place, and an electrochemically active cathode 120 is housed in the catholyte compartment 116 where reduction reactions take place. The sodium ion conductive ceramic membrane 112 selectively transfers sodium ions 122 from the anolyte compartment 114 to the catholyte compartment 116 under the influence of an electrical potential 124.

The electrolytic cell 110 is operated by feeding a sodium sulfide solution 126 into the anolyte compartment 114. The sodium sulfide solution 126 may be aqueous or nonaqueous. The sodium sulfide solution 126 may be a reaction product from Equation (5). The concentration of sodium sulfide in the aqueous solution should be below its saturation limit in water. The concentration of sodium sulfide in the aqueous solution is between about 1% by weight and about 20% by weight of the solution, and more preferably between about 10% by weight and 20% by weight of the solution at ambient temperature. The weight percent may vary at different temperatures. For example at higher temperatures the weight percent of sodium sulfide can go as high as 90%. The temperature range for the operation of this electrolytic cell may be 20° C. to 150° C. In one embodiment, the temperature range for the operation is between about 30° C. and about 80° C.

Water 128 is fed into the catholyte compartment 116. At least initially, the water 128 preferably includes sodium ions, which may be in the form of an unsaturated sodium hydroxide solution. The concentration of sodium hydroxide is between about 0.1% by weight and about 50% by weight of the solution. In one embodiment, the water 128 includes a dilute solution of sodium hydroxide. During operation, the source of sodium ions may be provided by sodium ions 122 transporting across the sodium ion conductive membrane 112 from the anolyte compartment 114 to the catholyte compartment 116.

The anode 118 can comprise any suitable anode material that allows the cell to oxidize sulfide ions in the anolyte when electrical potential passes between the anode and the cathode. Some examples of suitable anode materials include, but are not limited to, stainless steel, titanium, platinum, lead dioxide, carbon-based materials (e.g., boron-doped diamond, glassy carbon, synthetic carbon, etc.), and other known or novel anode materials. Additionally, in some embodiments the anode comprises a dimensionally stable anode, which may include, but is not limited to, rhenium dioxide and titanium dioxide on a titanium substrate, and rhenium dioxide and tantalum pentoxide on a titanium substrate.

The cathode 120 may also be fabricated of any suitable cathode that allows the cell to reduce water in the catholyte to produce hydrogen gas. In this regard, some examples of suitable cathode materials include, without limitation, nickel, stainless steel, graphite, a nickel-cobalt-ferrous alloy (e.g., a KOVAR® alloy), and any other suitable cathode material that is known or novel.

Under the influence of electric potential 124, electrochemical reactions take place at the anode 118 and cathode 120. Oxidation of sulfur ions to sulfur occurs at the anode 118, and reduction of water to form hydrogen gas 130 and hydroxyl ions occurs at the cathode 120. The hydrogen gas 30 may be recovered and combined with carbon monoxide produced according to Equation (5) to form syngas, a useful chemical product.

As the reactions occur at the electrodes, sodium ions 122 are transported from the anolyte compartment 114 across the sodium ion conductive ceramic membrane 112 into the catholyte compartment 116. The transported sodium ions 122 combine with the hydroxyl ions produced by the reduction of water at the cathode 120 to form a sodium hydroxide solution. This sodium hydroxide solution 132 may be removed from the catholyte compartment as a useful chemical product. Sulfur 134 may be recovered from the anolyte compartment 114 as a useful chemical product.

The chemical reactions in the electrochemical cell 110 are summarized below:

At the anode/anolyte compartment:

$$Na_2S \rightarrow 2Na^+ + S^{-2}$$

$$S^{-2} \rightarrow S + 2e^-$$

At the cathode/catholyte compartment:

$$2H_2O + 2e^- \rightarrow 2OH^- + H_2$$

$$2Na^+ + 2OH^- \rightarrow 2NaOH$$

Overall reaction:

$$Na_2S + 2H_2O \leftrightarrow 2NaOH + S + H_2 \quad (6)$$

This embodiment of the $Na_2SO_4$ conversion method further includes combining the CO and $H_2$ generated in Equations (5) and (6) respectively to form syngas (see FIG. 3 where the Electrochemical Cell depicted may be the Electrochemical Cell of FIG. 1). Syngas refers to a gas mixture that contains varying amounts of carbon monoxide and hydrogen. Syngas may also contain carbon dioxide. It has a much lower energy density compared to natural gas and may be used as a direct fuel source or as an intermediate for the production of other fuels or chemicals.

The method or process may further include recovering the NaOH and sulfur. Sodium hydroxide is a useful industrial chemical. It may be used directly as it is removed from the catholyte compartment 116 or it may be further processed or concentrated as desired.

Embodiment 2

Another embodiment of the $Na_2SO_4$ conversion method includes reacting $Na_2SO_4$ with carbon to make $Na_2S$ and CO, according to Equation (5), above. The process includes the step of reacting the $Na_2S$ product with iodine ($I_2$) to form sodium iodide according to Equation (7).

$$Na_2S + I_2 \leftrightarrow 2NaI + S \quad (7)$$

This reaction preferably proceeds in a non-aqueous solvent such as methyl alcohol ($CH_3OH$). Other non-aqueous solvents such as ethanol, acetone, liquid ammonia, liquid sulfur, dioxide, formic acid, acetonitrite, acete, formamide, acetamide, dimethylformamide, and the like may be used.

The sulfur precipitates from the methyl alcohol solution, as well any unreacted $Na_2SO_4$ and carbon from Equation (5). These solids may be recovered. Unreacted $Na_2SO_4$ and carbon may be recycled and further reacted according to Equation (5). The process further includes the step of electrolyzing NaI solution in methyl alcohol to generate iodine ($I_2$) and NaOH, according to Equation (8):

$$2NaI + 2H_2O \leftrightarrow 2NaOH + I_2 + H_2 \quad (8)$$

The iodine remains in the methyl alcohol and can be recycled and used again in the step of reacting the $Na_2S$ product with iodine ($I_2$) to form sodium iodide according to Equation (7).

The overall electrochemical process represented by Equation (8) preferably occurs in an electrolytic cell having a sodium ion conductive membrane. One presently preferred type of sodium ion conductive membrane includes sodium super ionic conductor (hereinafter "NaSICON") membrane technologies. The NaSICON membranes are permeable to sodium ions and impermeable to water. Such membranes provide effective separation between the aqueous catholyte compartment and the non-aqueous anolyte compartment.

FIG. 2 schematically shows one possible electrolytic cell 210 that may be used in the electrochemical process of electrolyzing NaI within the scope of the present invention. The electrolytic cell 210 uses a sodium ion conductive membrane 212 that divides the electrochemical cell 210 into two compartments: an anolyte compartment 214 and a catholyte compartment 216. A NaSICON membrane is preferred because it is permeable to sodium ions and impermeable to water. Such membranes provide effective separation between the aqueous catholyte compartment 216 and the non-aqueous anolyte compartment 214.

An electrochemically active anode 218 is housed in the anolyte compartment 214 where oxidation reactions take place, and an electrochemically active cathode 220 is housed in the catholyte compartment 216 where reduction reactions take place. The sodium ion conductive ceramic membrane 212 selectively transfers sodium ions 222 from the anolyte compartment 214 to the catholyte compartment 216 under the influence of an electrical potential 224.

The electrolytic cell 210 is operated by feeding a sodium iodide in methyl alcohol 226 into the anolyte compartment 214. The sodium iodide solution 226 may be a reaction product from Equation (7). The concentration of sodium iodide in the methyl alcohol solution should be below its saturation limit. The concentration of sodium iodide in methyl alcohol is between about 10% by weight and about 80% by weight of the solution, and more preferably between about 35% by weight and 50 by weight of the solution. An increase in temperature can increase the range. It will be appreciated that other non-aqueous solvents may be used besides methyl alcohol, including but not limited to, ethanol, acetone, liquid ammonia, liquid sulfur, dioxide, formic acid, acetonitrite, acete, formamide, acetamide, dimethylformamide, and the like.

Water 228 is fed into the catholyte compartment 216. At least initially, the water 228 preferably includes sodium ions, which may be in the form of an unsaturated sodium hydroxide solution. The concentration of sodium hydroxide is between about 0.1% by weight and about 50% by weight of the solution. In one embodiment, the water 228 includes a dilute solution of sodium hydroxide. During operation, the source of sodium ions may be provided by sodium ions 222 transporting across the sodium ion conductive membrane 212 from the anolyte compartment 214 to the catholyte compartment 216.

The anode 218 can comprise any suitable anode material that allows the cell to oxidize iodide ions in the anolyte when electrical potential passes between the anode and the cathode. Some non-limiting examples of suitable anode materials are discussed above in relation to FIG. 1. The cathode 220 may also be fabricated of any suitable cathode that allows the cell to reduce water in the catholyte to produce hydrogen gas. In this regard, some non-limiting examples of suitable cathode materials are discussed above in relation to FIG. 1.

Under the influence of electric potential 224, electrochemical reactions take place at the anode 218 and cathode 220. Oxidation of iodide ions to iodine occurs at the anode 218, and reduction of water to form hydrogen gas 230 and hydroxyl ions occurs at the cathode 220. The hydrogen gas 230 may be recovered and combined with carbon monoxide produced according to Equation (5) to form syngas, a useful chemical product.

As the reactions occur at the electrodes, sodium ions 222 are transported from the anolyte compartment 214 across the sodium ion conductive membrane 212 into the catholyte compartment 216. The transported sodium ions 222 combine with the hydroxyl ions produced by the reduction of water at the cathode 220 to form a sodium hydroxide solution. This sodium hydroxide solution 232 may be removed from the catholyte compartment as a useful chemical product. Iodine 234 and methyl alcohol may be recovered from the anolyte compartment 214 and recycled for use in Equation (7).

The chemical reactions in the electrochemical cell 210 are summarized below:

At the anode/anolyte compartment 214:

$$NaI \rightarrow Na^{+}+I^{-}$$

$$2I^{-} \rightarrow I_2+2e^{-}$$

At the cathode/catholyte compartment 216:

$$2H_2O+2e^{-} \rightarrow 2OH^{-}+H_2$$

$$2Na^{+}+2OH^{-} \rightarrow 2NaOH$$

Overall reaction:

$$2NaI+2H_2O \leftrightarrow 2NaOH+I_2+H_2 \quad (8)$$

This embodiment of the $Na_2SO_4$ conversion method further includes the step of combining the CO and $H_2$ generated in Equations (5) and (8) to form syngas (see FIG. 4 where the Electrochemical Cell depicted may be the Electrochemical Cell of FIG. 2). The syngas may be used as a direct fuel source or as an intermediate for the production of other fuels or chemicals. This embodiment also includes the step of recovering the NaOH. Sodium hydroxide is a useful industrial chemical. It may be used directly as it is removed from the catholyte compartment 216 or it may be further processed or concentrated as desired.

Additionally, the method of this embodiment may include recycling the iodine produced in Equation (8) to react with sodium sulfide according to Equation (5).

Referring now to FIG. 5, a process flow diagram is shown. In one embodiment, a process for electrochemically converting an alkali sulfate into useful chemical products, comprises reacting an alkali sulfate with carbon according to reaction (1) to produce carbon monoxide and $M_2S$. In one embodiment, the $M_2S$ may be dissolved in water to form aqueous $M_2S$. In another embodiment, the $M_2S$ may be dissolved in a non-aqueous solution to form nonaqueous $M_2S$. The alkali sulfide in the aqueous or non aqueous solution may be between about 1% by weight and about 90% by weight of the solution.

An electrolytic cell of the type depicted in FIG. 1 may be provided comprising an alkali ion conducting membrane configured to selectively transport alkali ions. The alkali ion conducting membrane is selected from a NaSICON membrane, a KSICON membrane, and a LiSICON membrane. The membrane is positioned between an anolyte compartment configured with an anode and a catholyte compartment configured with a cathode. The aqueous $M_2S$ is introduced into the anolyte compartment and water is introduced into the catholyte compartment. The aqueous $M_2S$ and water are electrolyzed to form MOH, $H_2$ and sulfur, according to reaction (3). In one embodiment, M is an alkali metal such as sodium, lithium, or potassium.

The CO from reaction (1) and $H_2$ from reaction (3) are recovered and combined to form syngas. The syngas may be an intermediate for the production of other fuels or chemicals. In one embodiment, the MOH from reaction (3) is recovered for later use. The MOH is concentrated by removing water. The carbon which reacts with the alkali sulfate in Equation 1 is selected from a carbon source selected from coal, charcoal, tar, lignin, and combinations thereof. In one embodiment, reaction (1) proceeds at a temperature in the range from 700 to 1600° C. and the reaction (1) proceeds under anaerobic conditions.

FIG. 5 also represents the process for electrochemically converting an alkali sulfate into useful chemical products after an alkali sulfate is reacted with carbon according to reaction (1), the $M_2S$ is further reacted with iodine in a methyl alcohol solvent according to reaction (2). The process proceeds as above by providing an electrolytic cell comprising an alkali ion conducting membrane configured to selectively transport alkali ions where the membrane positioned between an anolyte compartment configured with an anode and a catholyte compartment configured with a cathode. The MI in methyl alcohol from reaction (2) is introduced into the anolyte compartment and water is introduced into the catholyte compartment. The MI and water are electrolyzed in the electrolytic cell to form MOH, $H_2$ and iodine, according to reaction (4). As discussed above, M is an alkali metal. For example, M may be sodium, lithium, potassium, or other alkali metals. The CO from reaction (1) and $H_2$ from reaction (4) are recovered and combined to form syngas, which may be used as an intermediate for the production of other fuels or chemicals.

In this embodiment, the process also includes recovering MOH from reaction (3) and concentrating it by removing water. The carbon is selected from a carbon source selected from coal, charcoal, tar, lignin and combinations thereof. The alkali ion conducting membranes are the same as discussed with earlier embodiment and the reaction (1) proceeds at similar temperatures under similar anaerobic conditions. The iodine produced in reaction (4) may be recycled to react with further alkali sulfide.

A process test including mixing 2.5 grams of Sodium sulfate with a molar excess of high surface area graphite (1:4.25) and reacted at a temperature of 800° C. in an Argon atmosphere. The duration of the heating cycle was 24 hours. The product mixture was examined by X-ray diffraction. The peaks in the X-ray pattern were identified to be sodium sulfide and residual graphite. One part of the mixture was then dispersed in methyl formamide, which selectively dissolved sodium sulfide while leaving the solid graphite which was removed by centrifugation. A second part of the mixture was reacted with an iodine solution in methanol (molar ratio of $Na_2S:I_2$::1:1) at 45° C. The reaction resulted in formation of sodium iodide product which dissolved in methanol while sulfur and carbon remained as solids which were retrieved by centrifugation. As before the solid products were identified by X-ray diffraction. The methanol solution containing sodium iodide was heater to evaporate methanol and retrieve solid sodium iodide which was also identified by X-ray diffraction.

It will be appreciated that the disclosed embodiments provide electrochemical processes to convert alkali sulfates into useful chemical products, such as syngas, alkali hydroxide, and sulfur.

While specific embodiments and examples of the present invention have been illustrated and described, numerous modifications come to mind without significantly departing from the spirit of the invention, and the scope of protection is only limited by the scope of the accompanying claims.

The invention claimed is:

1. A processes for electrochemically converting an alkali sulfate into useful chemical products, comprising:

reacting an alkali sulfate with carbon according to reaction (1):

$$M_2SO_4+4C \leftrightarrow 4CO+M_2S \quad (1)$$

wherein M is an alkali metal;

reacting alkali sulfide ($M_2S$) with iodine in a methyl alcohol solvent according to reaction (2):

$$M_2S+I_2 \leftrightarrow 2MI+S \quad (2);$$

providing an electrolytic cell comprising an alkali ion conducting membrane configured to selectively transport alkali ions, the membrane positioned between an anolyte compartment configured with an anode and a catholyte compartment configured with a cathode;

introducing MI in methyl alcohol into the anolyte compartment;

introducing water into the catholyte compartment; and electrolyzing MI and water to form MOH, $H_2$ and iodine, according to reaction (3):

$$2MI+2H_2O \leftrightarrow 2MOH+I_2+H_2 \quad (3).$$

2. The process according to claim 1, wherein CO from reaction (1) and $H_2$ from reaction (3) are recovered and combined to form syngas.

3. The process according to claim 2, wherein the syngas is an intermediate for the production of other fuels or chemicals.

4. The process according to claim 1, wherein MOH from reaction (3) is recovered.

5. The process according to claim 4, wherein the MOH is concentrated by removing water.

6. The process according to claim 1, wherein the carbon which reacts with the alkali sulfate is selected from a carbon source selected from coal, charcoal, tar, lignin, and combinations thereof.

7. The process according to claim 1, wherein the alkali ion conducting membrane is selected from a NaSICON membrane, a KSICON membrane, and a LiSICON membrane.

8. The process according to claim 1, wherein reaction (1) proceeds at a temperature in the range from 700 to 1600° C.

9. The process according to claim 1, wherein reaction (1) proceeds under anaerobic conditions.

10. The process according to claim 1, wherein the iodine produced in reaction (3) is recycled to react with further alkali sulfide.

* * * * *